US007431615B2

(12) United States Patent
Ho

(10) Patent No.: US 7,431,615 B2
(45) Date of Patent: Oct. 7, 2008

(54) REDUCED THREADS COAXIAL CONNECTOR

(76) Inventor: Kesse C. Ho, 13461 Pepperdine Cir., Westminster, CA (US) 92683

( * ) Notice: Subject to any disclaimer, the term of this patent is extended or adjusted under 35 U.S.C. 154(b) by 0 days.

(21) Appl. No.: 11/890,117

(22) Filed: Aug. 3, 2007

(65) Prior Publication Data

US 2008/0139045 A1 Jun. 12, 2008

Related U.S. Application Data

(60) Provisional application No. 60/873,810, filed on Dec. 9, 2006.

(51) Int. Cl.
*H01R 9/05* (2006.01)

(52) U.S. Cl. ..... 439/578

(58) Field of Classification Search ..... 439/578
See application file for complete search history.

(56) References Cited

U.S. PATENT DOCUMENTS 3,845,453 A * 10/1974 Hemmer ..... 439/578

* cited by examiner

*Primary Examiner*—Javaid Nasri
(74) *Attorney, Agent, or Firm*—Vista IP Law Group LLP; William A. English

(57) ABSTRACT

Male and female reduced thread coaxial connectors for interconnecting center and outer conductors of pairs of coaxial signal lines each has a rear tubular connector body section for attachment in electrically conductive contact to the outer conductor of a coaxial cable and a front cylindrically shaped body section which is in electrically conductive contact with the rear body section and protrudes axially forward therefrom. The front body section of the male reduced thread connector has a longitudinally disposed bore, the circumferential wall surface of which has in a rear portion thereof helical threads adapted to threadingly engage threads on an outer cylindrical surface of the front connector body section of a standard fully threaded female coaxial connector, and a front unthreaded portion which is adapted to insertably receive the front female connector body section and thereby guide the axes of the female and the male connectors into alignment prior to mutual contact of their threaded surfaces. The front body section of the reduced thread female connector has an outer cylindrical wall surface which has in a rear portion thereof helical threads adapted to threadingly engage helical threads of a standard fully threaded male connector, and a front unthreaded portion which is adapted to be inserted into the bore of the male connector body section and thereby guide the axes of the male and female connectors into axial alignment prior to mutual contact of their threaded surfaces.

27 Claims, 6 Drawing Sheets

REDUCED THREADS COAXIAL CONNECTOR

The present application claims priority to U.S. provisional patent application No. 60,873,810, filed on Dec. 9, 2006 by the present inventor.

BACKGROUND OF THE INVENTION

A. Field of the Invention

The present invention relates to connectors for use with coaxial cables used to carry high frequency analog signals such as video, television, satellite signals, and high-speed digital data signals. More particularly, the invention relates to a coaxial connector of novel design which facilitates connecting and disconnecting the connector to target mating connectors of various types, with greater speed and less likelihood of mis-aligning or cross-threading the target connector than possible with pre-existing connectors.

B. Description of Background Art

There are available a variety of connector types for connecting the conductors of a coaxial electrical signal cable with corresponding conductors of another cable or with an electronic device such as a satellite or television receiver or antenna, electronic test instrument, computer apparatus or the like. A typical electrical connection, between a coaxial cable carrying high-frequency analog or digital electrical signals and another cable or an electronic device uses a mateable pair of releasably engageable, complementary connectors. Such connector pairs typically consist of a male connector part which has an outer tubular cylindrical conductive tube that is joined at a rear end thereof to a braided conductive metal sheath which serves as the outer, low potential conductor of a coaxial cable. The male connector part has located within the conductive tube, a central coaxially located axial connector pin which is in electrically conductive contact with, or is forwardly extended portion of, a central conductor of the coaxial cable. The center axial pin of the male coaxial connector part usually extends to the front transverse annular end wall of the outer tube of the connector, or slightly beyond.

A typical female coaxial connector part for mating with a male connector part of the type described above typically includes an elongated outer conductive shell which is adapted to fit coaxially within and make electrically conductive conduct with the inner cylindrical surface of the male connector tube. The rear part of the shell is conductively connected to a rear connector termination, such as the outer conductive sheath of another coaxial cable, or a ground plane of a printed circuit board, for example. The bore of the outer shell of a female coaxial connector usually contains a cylinder made of an insulating material such as PTFE which has good high-frequency dielectric properties. The female connector also has protruding longitudinally rearwards from the flat front transverse face of the dielectric cylinder an elongated conductive ferrule which is electrically connected to a rear center conductor termination of the female connector. The ferrule typically has a chamfered front entrance opening and is elastically deformable in diameter, to thereby receive in a tight compression fit the center axial pin of the male connector, when the two connector parts are pressed longitudinally together.

Some coaxial connector pairs of the type described above are constructed in a way that permits the two parts of the connector to be electrically and mechanically connected simply by inserting the female connector outer shell into the male connector tube bore. Such "push-on," or "quick" connectors typically use a resiliently outwardly deformable male connector tube to frictionally retain the inserted female shell within the bore of the tube. To provide this resilient deformability, typical male push-on connectors have one or more slots which extend longitudinally rearward from the front transverse face of the tube, forming therebetween a resiliently deformable tab. The tube is made of a springy metal, and has an undeformed inner diameter slightly less than the outer diameter of the female connector shell, thus enabling the tabs of the male tube to resiliently deform radially outwardly and grip the female shell when the shell is inserted into the bore of the tube.

Although push-on connectors of the type described above are sometimes used in indoor applications, such use is generally confined to low frequency video applications, because of their poor RF characteristics as compared to threaded connectors. Moreover, they are unsuitable for outdoor use because typical push-on connectors are not water-tight, and therefore may admit dust as well as atmospheric moisture in the form of rain or condensation into the interior of the connector pair. Such moisture is problematic not only because it can corrode and degrade connector components, but because it can substantially alter both DC and RF electrical properties of the connector pair. Thus, as is well known to those skilled in the art, connecting a coaxial cable of a particular characteristic impedance to a mismatched impedance caused by variations in electrical properties of a connector will result in significant signal insertion loss and reflections.

For the foregoing reasons, coaxial connections made to satellite antenna dishes, off-air television antennas and other outdoors equipment routinely are made using coaxial connector pairs in which the female shell has external threads that engage internal threads on the inner surface of the male connector tube. Such connectors suitable for use outdoors usually include a resilient rubber O-ring or flat washer seated at a rear flange wall located at the inner end of the male tube. When the threaded female shell is threadingly advanced sufficiently far into the bore of the male connector tube, the front transverse wall of the female connector part compresses the O-ring or washer to form a water-tight seal. To further ensure against water penetration into mating parts of the connector pair halves, a tubular boot made of a water-impervious, elastomeric material such as silicone rubber is sometimes fitted over mating connector parts.

A widely used threaded coaxial connector of the type described above is referred to as an "F-connector." Male and female F-connector parts typically have threads which span the full length of the inner tube surface or outer shell surface, respectively. Each connector part can have a relatively large number of threads, e.g., 5-8 or more.

One of the problems with fully-threaded connectors is that when they are deployed in the field for a period, and exposed to weather conditions, the connectors often become dirty, corroded and difficult to unscrew without the use of a wrench. But often the connectors are grouped so closely together that there is simply no space for a wrench. Corrosion occurs because the rubber O-ring at the bottom of the male connector may stop water and moisture from reaching the inner conductors, but water and dirt can still penetrate voids between mating connector threads. Therefore, the more threads there are on a connector, the harder it may become to unscrew the connector after exposure to the elements.

Furthermore, conventional screw-on, screw-off operations become laborious when the number of connections to be made is increased. As a result, an installer may fail to screw a connector in all the way, thus again resulting in moisture entering the connector even if there is a rubber O-ring seal at the base of the male-connector.

Moisture in a connection changes the system characteristic impedance and causes RF signal reflection, a very undesirable condition in any video or RF frequency application, which can be characterized as a degradation in Return Loss (RL). Return Loss is a measure of how closely the impedance of a source matches that of a load. A mis-match causes degradation of signal power transfer and degradation of system frequency response. To combat the moisture problem, a "weather boot" is often employed. But weather boots are bulky and of limited use in tight spaces. The weather boot is somewhat water-proof but not moisture-proof. Also, changes in temperature during the days and the nights can cause moisture to be admitted into the connection.

Another problem with fully-threaded connectors is initial alignment. The connectors will not mate if they are not perfectly aligned, necessitating trial-and-error time to be expended by an installation technician. Mis-alignment can result in cross-threading, and may damage the male and/or female threads if forced, thus making removal even more difficult. Since cross-threading often results in imperfect mating, the potential of allowing water and/or moisture to accumulate in the connector cavity is increased, even if the intended rubber "O" ring is in place.

As stated above, one prior art solution for solving the difficulties of fully-threaded connectors has been to use a non-threaded, push-on male connector. But connections made by push-on connectors are not water/moisture-sealed, and allow water/moisture to seep into the connectors, thus degrading the performance and causing poor Return Loss (RL). This results in system degradation.

Also, a push-on connection can be pulled off very easily. Equally troublesome, a connection may be pulled loose but allow connectors to hang onto each other. The installer often cannot tell if a connection is loose, thus spending unnecessary time trying to trouble shoot system problems elsewhere.

A less obvious problem with push-on connectors is that even when seated properly, a push-on connection has an inferior RL performance compared to that of the equivalent threaded types and is best used for lower-frequency applications, rather than the high frequencies employed in fields such as satellite signal distribution and the cable industry's HDTV signal distribution.

The present invention was conceived of to provide an improved coaxial connector which overcomes problems associated with prior art coaxial connectors of the type described above.

OBJECTS OF THE INVENTION

An object of the present invention is to provide an electrical connector for mechanically and electrically interconnecting conductors of a coaxial signal line to corresponding conductors of a target signal line.

Another object of the invention is to provide a reduced threads male coaxial connector which includes an elongated outer tube made of an electrically conductive material that has an inner helically threaded wall surface which spans less than the full length of the tube and is adapted to engage an outer cylindrical wall surface of a female coaxial connector.

Another object of the invention is to provide a reduced threads male coaxial connector which includes an elongated tube made of an electrically conductive material that has on an inner cylindrical wall thereof a helically threaded surface which extends from an inner annular flange wall thereof to a location longitudinally inwards of an outer transverse end wall of the tube, the threaded surface being adapted to engage an outer cylindrical wall surface of a female coaxial connector, and an unthreaded tube wall surface located between the threaded surface and the outer annular wall surface of the tube.

Another object of the invention is to provide a reduced threads female coaxial connector which includes an elongated cylindrical shell made of an electrically conductive material that has on an outer cylindrical wall surface thereof a helically threaded surface which spans less than the length of the shell and is adapted to engage an inner wall surface of a male coaxial connector.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a reduced threads electrical connector for mechanically and electrically interconnecting center and outer conductors of two coaxial signal lines. A reduced threads coaxial connector according to the present invention includes an outer tubular connector body which has a coaxially centrally located bore for receiving an inner axial conductor. A male embodiment of a reduced thread coaxial connector according to the present invention which is adapted to mate with a conventional female threaded coaxial connector has on an inner cylindrical wall surface of the outer tubular connector body a helically threaded surface which extends longitudinally outwards from an inner transverse annular flange wall of the body. A longitudinally outwardly located portion to the cylindrical bore of the male connector tubular body which extends longitudinally outwardly from the threaded surface to the outer transversely disposed annular end wall of the body has a smooth, unthreaded bore of a diameter greater than the inner diameter of the threaded portion of the bore. The smooth, unthreaded portion of the bore of the tubular connector body extends an appreciable axial distance inwardly of the outer transverse end wall of the body, e.g., more than 25 percent.

According to the invention, the inner helically threaded wall surface of the male tubular connector body is adapted to threadingly engage the threaded outer cylindrical wall surface of the outer conductive tubular shell portion of a conventional complementary female coaxial connector which the reduced thread male coaxial connector is adapted to mate with. This construction allows the threaded female connector shell to be inserted a substantial distance into the smooth bore portion of the male connector body bore before contacting the threaded portion of the male connector body bore. The smooth bore thus serves as a tubular pilot guide which ensures that male and female connectors are axially aligned before inner and outer respective threaded surfaces thereof make contact. Thus, axial misalignment of the male and female coaxial connectors is precluded, facilitating threadingly tightening the connectors together. Moreover, the reduced number of threads in the male connector, e.g., 1 to 3 rather than 5 to 8, reduces proportionately the number of turns required to tighten or loosen a connection made by the connector.

In a preferred embodiment of a male reduced threads coaxial connector according to the present invention, the tubular outer body of the male connector has a radially inwardly beveled outer rear transition surface which joins the cylindrically-shaped front portion of the body to a cylindrically-shaped rear portion of smaller diameter than the front portion. In this embodiment, an inner end of the bore of tubular body also tapers radially inwards from an inner end of the threaded portion of the bore. An unthreaded inner end of the bore at the junction between the inner end of the threaded portion of the bore, and the tapered section, provides an annular flange on which a resilient O-ring or washer is seated. This construction provides a sealing annular contact surface for the front end wall of a female coaxial connector shell. Also, a central coaxial bore through tapered inner wall surface of the male tubular connector body provides a clearance space for the forward projecting, unthreaded chamfered front annular surface of a female connector shell.

A male reduced threads coaxial connector according to the present invention preferably has a construction which facilitates making an electrically conductive connection between the outer conductive tubular body of the connector and the outer conductor of a coaxial line, such as an outer braided metal sheath of a coaxial cable. That construction may consist of a rear crimp ring, a solderable or weldable rear body surface, or any other suitable expedient.

Also, a male reduced threads coaxial connector according to the present invention preferably has a construction which facilitates making electrical contact between a central axial conductor of a female coaxial connector and a center conductor of a coaxial line which the male coaxial connector terminates. That construction may consist of a central coaxial aperture through the male tubular connector body, which is adapted to receive axially therethrough the center conductor of a coaxial cable that protrudes longitudinally forwards sufficiently far to be received in a conductive central ferrule of a female coaxial connector threadingly engaged with the reduced threads male coaxial connector.

A female embodiment of a reduced threads coaxial connector according to the present invention has a construction similar to that of prior art female coaxial connectors of the type having an elongated cylindrically-shaped outer conductive shell which is provided with an external helically threaded surface that extends from an outer transverse end wall of the shell over a substantial portion of the length of the shell. However, the outer cylindrical wall surface of the shell of a reduced threads female coaxial connector according to the present invention has a smooth, unthreaded surface of a diameter less than that of the threaded portion of the shell. The unthreaded surface extends an appreciable axial distance inwardly of the outer transverse end wall of the shell, e.g., more than 25 percent. This construction affords the advantages of pre-alignment and reduced number of turns required for connecting and disconnecting the female coaxial connector from a male coaxial connector, for the same reasons as described above for the male reduced thread coaxial connector.

DESCRIPTION OF THE PREFERRED EMBODIMENTS

An appreciation of certain advantages of the present invention over the prior art may be best facilitated by first reviewing certain characteristics of prior art coaxial connectors.

Figure 1:
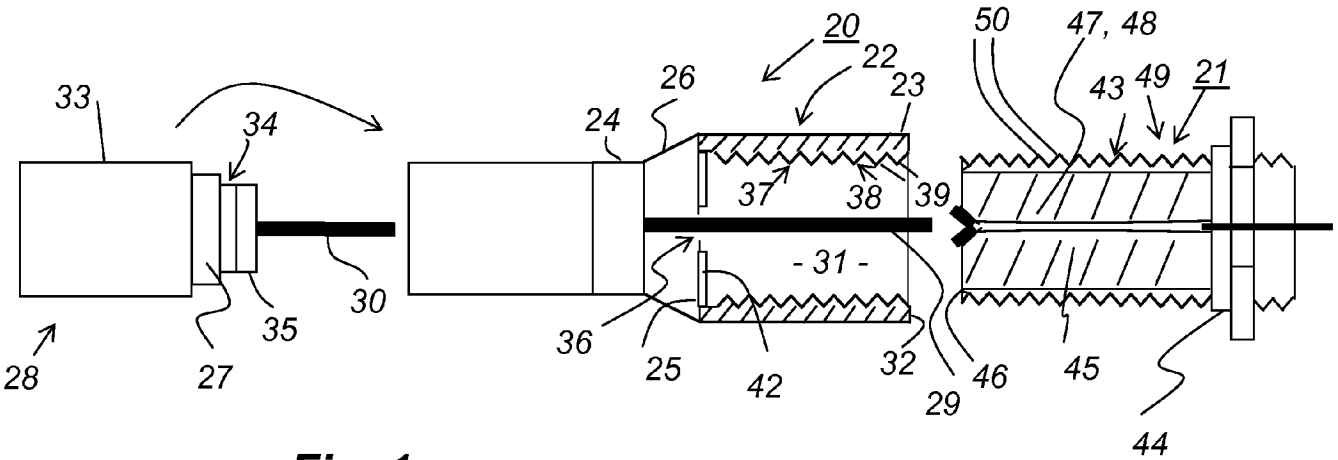
Fig. 1 (Prior Art)
FIG. 1 is a partly sectional view of a prior art male coaxial connector and a complementary female coaxial connector.

FIGS. 1-5 illustrate a prior art fully-threaded male coaxial connector 20 and a prior art female coaxial connector 21 which is adapted to mate with connector 20. As shown in FIG. 1, male connector 20 includes a cylindrically-shaped tubular body 22 that has a front elongated tubular section 23 made of an electrically conductive material such as nickel plated zinc. Body 22 includes a short rear tubular section 24 of smaller diameter than front tubular section 23 which is joined at a rear annular flange 25 of the front tubular section by an annular transition section 26. Rear tubular section 24 is in electrically conductive contact with transition section 26 and front tubular section. Typically, the foregoing sections of connector 20 are made from a single piece of metal tube stock.

Rear tubular section 24 is adapted to be coaxially secured in mechanical and electrically conductive connection with the outer braided conductive metal sheath 27 of a coaxial cable 28, as by crimping the rear tubular section onto the sheath.

Male coaxial connector 20 includes a longitudinally disposed center axial connector pin 29 which is in electrically conductive contact with the center conductor 30 of coaxial cable 28,and which extends forward from a rear annular flange 25 located at the inner or bottom end of a bore 31 through front tubular connector section 23. Center axial connector pin 29 typically extends forward at least as far as front annular wall 32 of tubular connector section 23, and usually a short distance outwardly thereof.

In a typical prior art male coaxial connector 20, center axial conductor pin 29 of the connector is formed by cutting through the insulation jacket 33, braided metal sheath 27, underlying foil shield 34, and dielectric core 35 of a coaxial cable 28. The cuts are made transversely inwards towards central conductor 30 of the cable, leaving an extension thereof to protrude through a center coaxial hole 36 through flange 25, the extension forming central axial conductor pin 29.

Figure 2:
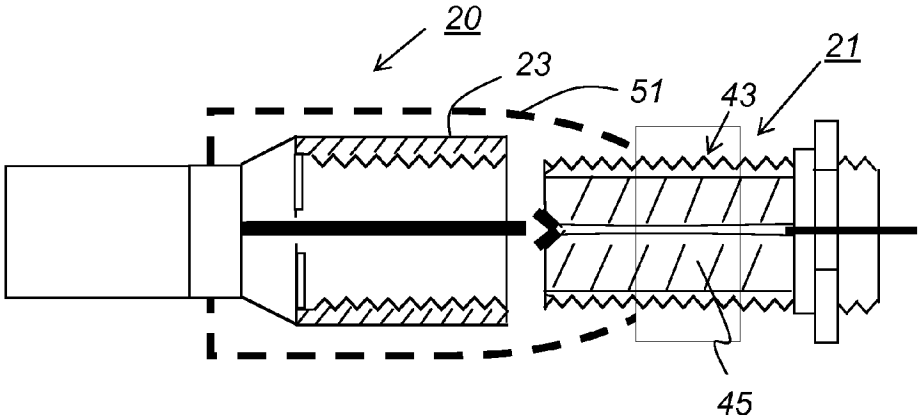
Fig. 2 (Prior Art)
FIG. 2 is a view showing the prior art connector pair of FIG. 1 with a weather protection boot fitted to the female connector.

Referring still to FIGS. 1 and 2, it may be seen that inner cylindrical wall surface 37 of male coaxial connector body 22 has formed therein a helically threaded surface 38 containing a plurality, e.g., 5-8 threads 39. As shown in the figures, threads 39 extend longitudinally inwards from front transverse annular wall surface 32 of connector body 22 and span the full length of bore 31 through the body, terminating at an inner end thereof at rear annular flange 25. Sometimes a resiliently deformable rubber washer 42 or O-ring is positioned on flange 25.

As may also be seen by referring to FIGS. 1 and 2, prior art female coaxial connector 21 includes a longitudinally elongated, circular cross section cylindrical shell 43. Shell 43 is made of an electrically conductive metal, and typically has a rear stepped diameter boss section 44 of larger diameter than shell 43. Boss section 44 is made of a conductive metal which is continuous with or in electrically conductive contact with front shell 43, and is adapted to make electrically conductive contact with an outer coaxial conductor such as the braided metal sheath of a coaxial cable, by means of crimp ring (not shown), soldering, welding or any other suitable expedient. Boss section 44 may alternatively be coupled to a ground plane of a printed contact board, equipment box, etc. (not shown).

Referring still to FIGS. 1 and 2, it may be seen that prior art female coaxial connector 21 includes a cylindrically-shaped dielectric core 45 coaxially located in a cylindrically-shaped bore 46 through conductive shell 43. Dielectric core 45 typically is made of PTFE or other low-loss insulating dielectric material.

As shown in FIGS. 1 and 2, dielectric core 45 of female coaxial connector 21 has protruding inwardly from outer transverse circular end face 46 thereof a longitudinally inwardly disposed central coaxial bore 47. The latter has located coaxially therewithin an elongated conductive metal tube or ferrule 48 which is adapted to receive in an electrically conductive interference fit central conductor pin 29 of male coaxial connector 20.

Figure 4:
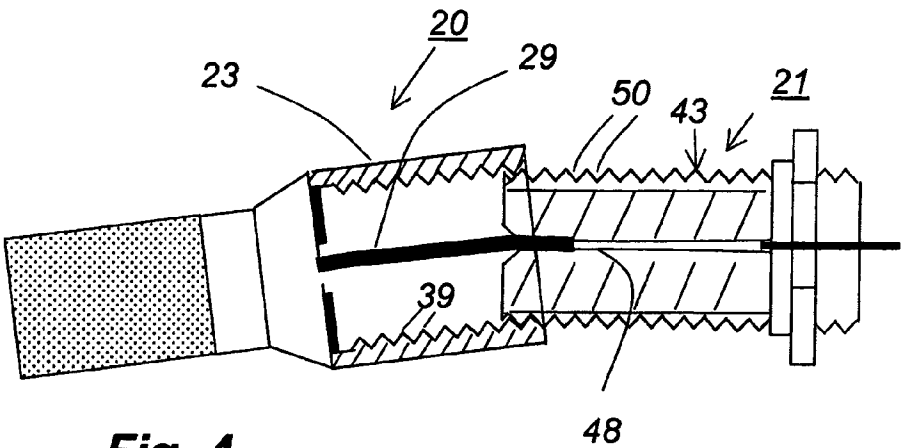
Fig. 4 (Prior Art)
FIG. 4 is a partly sectional view of the prior art connector pair of FIG. 1, showing misalignment of threaded surfaces of male and female connectors.

As shown in FIGS. 1 and 2, shell 43 of female coaxial connector 21 has on an external cylindrical wall surface 49 thereof helically disposed threads 50 which extend the full length of the shell. As may be understood by referring to FIG. 4, external threads 50 of female coaxial connector shell 43 are adapted to threadingly engage internal threads 39 of front tubular section 23 of male coaxial connector body 22. But, as is also shown in FIG. 4, the respective threaded portions of the prior art male and female coaxial connectors are subject to mis-alignment. The mis-alignment can require time consuming repetitive trials by an installation technician to correct, and if mis-aligned connector parts are forcibly engaged, cross-threading and damage to both threaded surfaces may occur.

Figure 3:
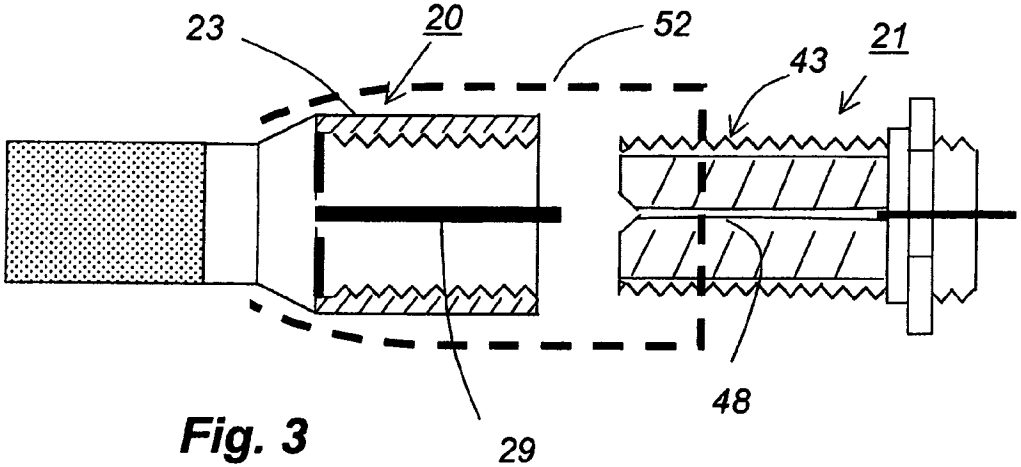
Fig. 3 (Prior Art)
FIG. 3 is a view similar to that of FIG. 1 showing a weather protection boot fitted to the male connector.

FIGS. 2 and 3 illustrate prior art coaxial connectors in which an elastomeric, water impervious weather boot 51 or 52 is fitted over a female or male connectors 21, 20, respectively. Although such weather boots are more or less effective in preventing rain from entering into the interior portion of the connectors, they are generally ineffective in preventing condensation moisture from entering and causing corrosion of metal parts of the connectors.

Figure 5:
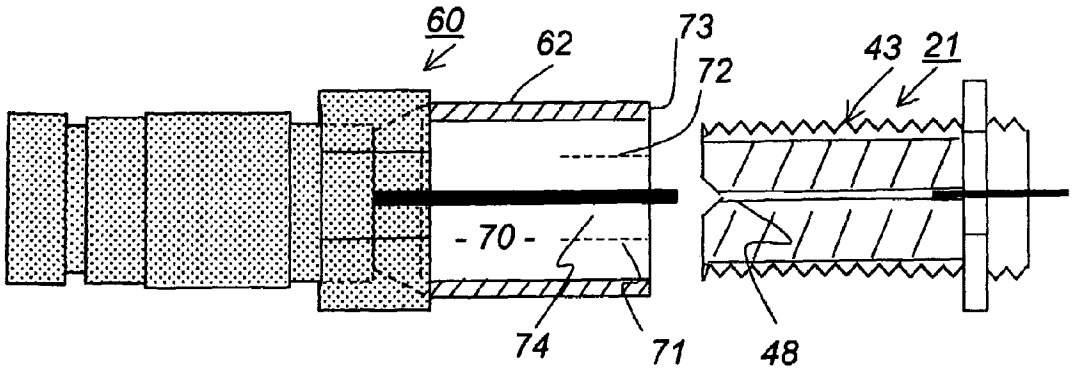
Fig. 5 (Prior Art)
FIG. 5 is a partly sectional view of a prior art push-on male coaxial connector and a complementary female connector.

FIG. 5 illustrates a "push-on" or "quick" prior-art, F-type male coaxial connector. As shown in FIG. 5, push-on connector 60 is similar in construction to prior art threaded male connector 20 described above. However, front tubular body 62 of connector 60 has a completely smooth, unthreaded bore 70. Body 62 is made of a springy metal material which has cut transversely through the thickness dimension thereof at least one and typically two pairs of parallel slots 71, 72 which extend longitudinally inwards from outer annular wall surface 73 of tubular body 62, forming between the slots a longitudinally disposed, rectangularly-shaped tab 74. Bore 70 of tubular connector body 62 is of slightly smaller diameter than the outer diameter of threaded conductor shell 43 of female coaxial connector 21, e.g., 0.010 inch. Thus, tabs 74 are resiliently deformed radially outwardly when shell 43 is pushed into bore 70 of body 62, thus causing the tabs to resiliently grip and electrically conductively contact shell 43. As can readily be appreciated, slots 71, 72 provide large entrance paths for moisture and dust into the interior of push-on connector 60, thus making that connector type totally unsuitable for use outdoors or in humid, dirty environments in general.

Figure 6:
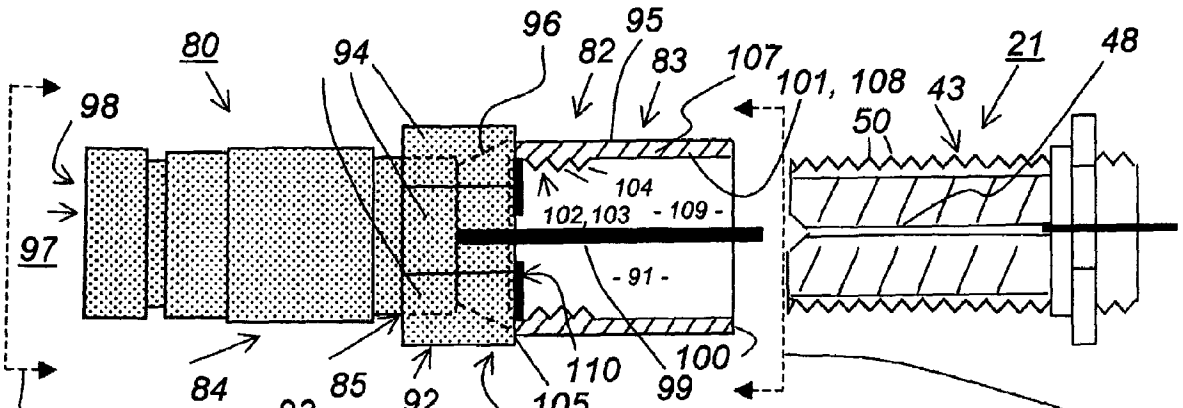
FIG. 6 is a partly sectional view of a reduced thread male coaxial connector according to the present invention, and a complementary unchamfered female complement.
Figure 6A:
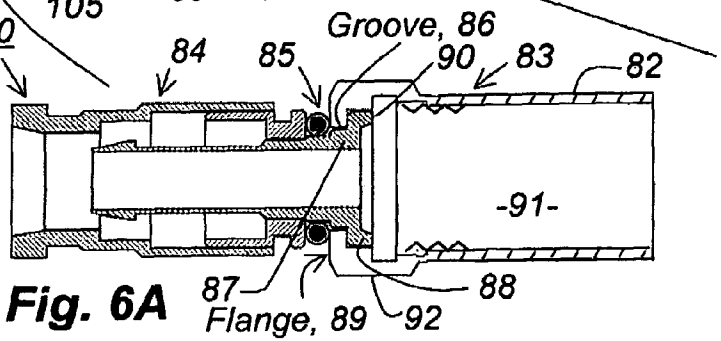
FIG. 6A is a vertical longitudinal sectional view of the male connector of FIG. 6.
Figure 8:
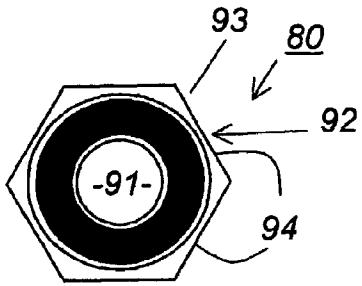
FIG. 8 is a front elevation view of the male connector of FIG. 6.
Figure 7:
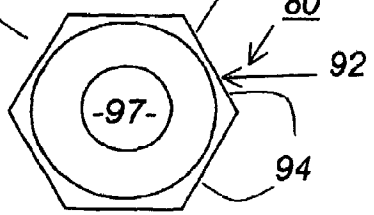
FIG. 7 is a rear elevation view of the male connector of FIG. 6.

FIGS. 6-8 illustrate a basic embodiment of a reduced threads coaxial male connector 80 according to the present invention.

As shown in FIG. 6, reduced threads male coaxial connector 80 includes a longitudinally elongated, cylindrically-shaped tubular body 82. Body 82 has a front tubular section 83 which is joined to a rear axially aligned tubular section 84. Preferably, the front and rear tubular sections 83, 84 are joined by a rotatable union 85 which enables the rear section to remain fixed in place while the front tubular section is rotatably fastened to a female coaxial connector, such as connector 21 shown in FIGS. 1 and 6 and described above. Rotatable union 85 includes a groove 86 which extends radially inwardly into the tubular body 87 of rear tubular section 84, just rearward of front annular face 88 of the rear tubular body. Groove 86 rotatably receives an annular ring-shaped flange 89 which protrudes radially inwardly from a rear inner cylindrical wall surface 90 of front tubular connector section 83 which circumscribes a bore 91 disposed longitudinally through the front tubular connector section.

Preferably, as shown in FIGS. 6, 7 and 8, front tubular section 83 of connector 80 has a step-wise enlarged diameter rear portion 92 which has formed in an outer longitudinally disposed wall surface 93 thereof a plurality of longitudinally disposed flats 94 which are adapted to be gripped between the jaws of a wrench which may be used to tighten or untighten the connector to a female connector. As shown in FIG. 7, connector 80 preferably has six flats 94 whose end view traces described a regular hexagon.

Referring to FIG. 6, it may be seen that front tubular section 83 of body 82 of connector 80 preferably has joined to a front uniform circular cross-sectional shape front circular cylindrical part 95 thereof an annular transition section 96 which is terminated near a rear end thereof by rear rotatable union flange 89, described above.

As shown in FIG. 6, front tubular section 83 of connector 80 has generally the shape of a thin-wall, uniform thickness cylindrical tube. Front tubular section 83 is made of an electrically conductive material, such as nickel plated zinc, and is in electrically conductive contact with rear tubular section 84. Rear tubular section 84 has disposed longitudinally through its length a bore 97 which is axially aligned with and communicates at a front end thereof with bore 91 through front tubular connector section 83. Bore 97 through rear tubular connector section 84 has a rear entrance opening 98 which is adapted to insertably receive and connect to the outer braided metal sheath 27 of a coaxial cable 28 (see FIG. 1), by crimping, compression or any other suitable expedient.

Referring still to FIG. 6, it may be seen that connector 80, when configured for connection to a female connector 21, has a central longitudinally disposed coaxial connector pin 99, for making electrically conductive contact between a center conductor 30 of a coaxial cable 28 and the central conductor 48 of a female connector 21. Center axial connector pin 99 preferably extends forward at least as far as front annular end wall 100 of front tubular connector section 83, and most preferably a short distance outwardly thereof. Preferably, central coaxial connector pin 99 is formed by cutting through the insulation jacket 33, braided metal sheath 27, underlying foil shield 34, and dielectric core 35 of a coaxial cable 28. The cuts are made transversely inwards towards central conductor 30 of the cable, leaving an uncut length of the central cable conductor to protrude through the bore 97 of rear tubular section and bore 91 of front tubular section, the extension serving as center connector terminal pin 99.

Referring still to FIG. 6, it may be seen that the inner longitudinally disposed cylindrical wall surface 101 of front tubular section 83 of connector 80 has formed in a rear portion 102 thereof a helically threaded surface 103 which has a plurality, e.g., one to three, of threads 104. As shown in FIG. 6, threaded surface 103 extends longitudinally forwards from a rear annular flange wall 105 of front tubular connector section 83, to a location offset a substantial distance rearwards of front annular wall surface 100 of the front tubular section. A front portion 107 of front tubular section 83, located between rear threaded portion 102 and front annular wall surface 100, has a smooth, unthreaded surface 108, thus forming a smooth entrance bore 109 into the front tubular section.

Smooth front entrance bore 109 of front tubular connector section 83 has a diameter larger than the thread diameter of rear threaded surface 103, and larger than maximum diameter of the front externally threaded tubular portion 43 of a female connector 21 which connector 80 is adapted to mate with. The novel reduced threads construction of male coaxial connector 80 according to the present invention affords an important operational advantage over prior art coaxial connectors, as will now be explained.

Thus, male connector 80 is connected to a female connector 21 by inserting the front tubular section 43 of the female connector into the smooth entrance bore 109 at the front of the male connector. Bore 109 of male connector 80 has a diameter just slightly greater than the diameter of front threaded portion 43 of female connector 21, e.g., 0.010 inch. Therefore, smooth bore portion 109 of front tubular section 83 serves as a guide or pilot tube which constrains the axis of front tubular section 43 of female connector 21 to be substantially parallel to the axis of front tubular section 83 of male connector 80. Consequently, when male and female connectors 80 and 21 are pushed together sufficiently far for the front threaded end of the female connector to contact a front outermost thread 104 of the male connector, the axes of the male and female connectors are constrained to be substantially aligned. This alignment ensures that when male connector 80 is rotated about its longitudinal axis in a predetermined clockwise or counterclockwise sense, depending on the chirality chosen for threaded surface 103, threads 104 of the male connector will threadingly engage threads 50 of the female connector, with no possibility of misalignment or cross-threading. Moreover, when male connector 80 is rotated in an opposite sense to disconnect the male connector from female connector 21, axial alignment of the connectors constrained by presence of a substantial forward length of female connector front tubular section 43 within the smooth, pilot entrance bore section 107 of the male connector ensures that threads on neither connector will be damaged by prematurely misaligning the axes of the connectors as the last mating threads are loosened, as is possible with prior art, full-thread length connectors.

As shown in FIG. 6, connector 80 according to the present invention preferably includes a resilient flat washer or O-ring 110 located at the bottom of threaded bore 103, seated on flange wall 105 at the bottom of threaded bore.

Figure 9:
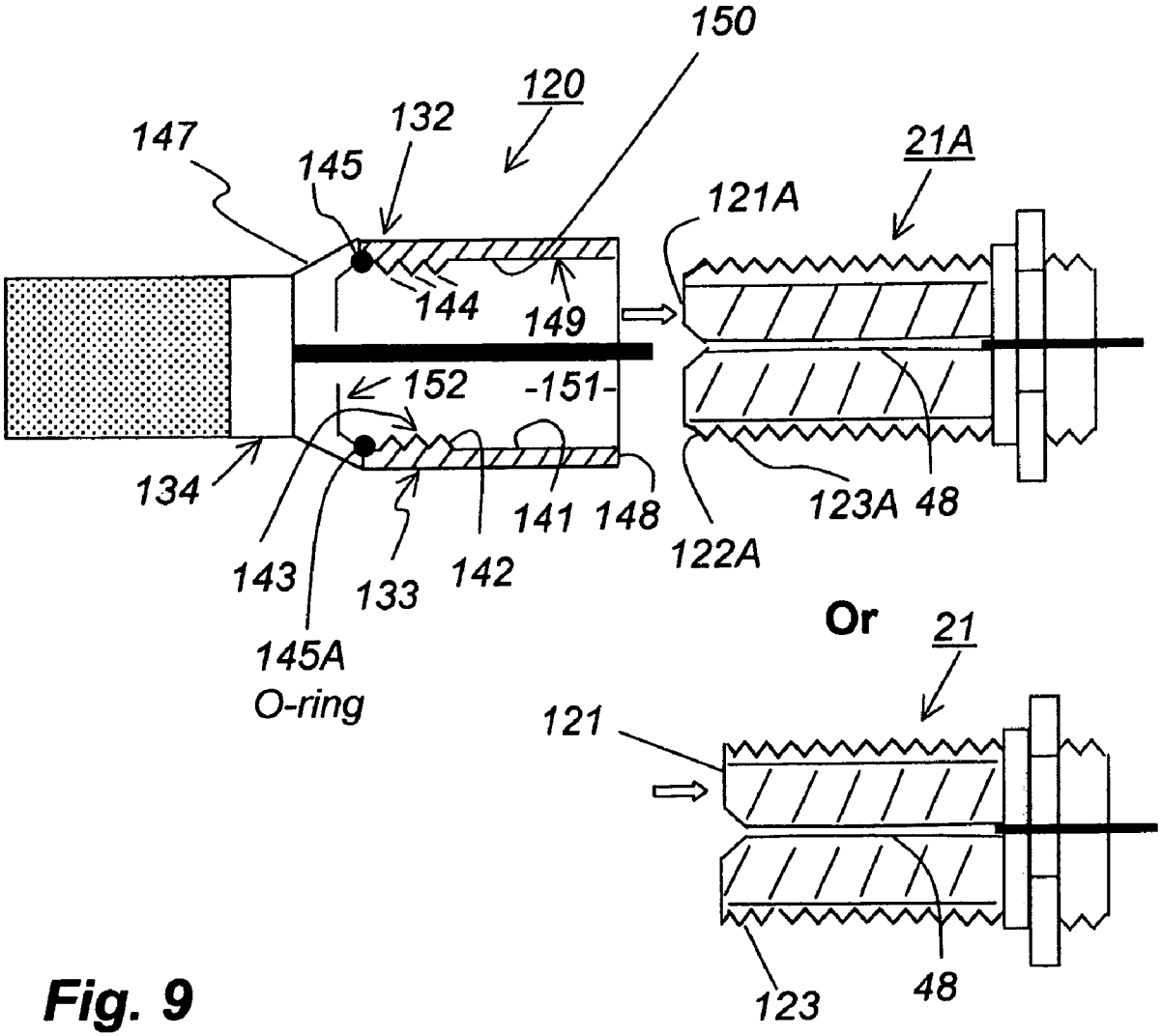
FIG. 9 is a partly sectional view of a modification of the male coaxial connector of FIG. 6, and showing complementary chamfered and unchamfered female coaxial connectors.

FIG. 9 illustrates a modification 120 of reduced threads male coaxial connector 80 shown in FIGS. 6-8 and described above. Modified reduced threads male coaxial connector 120 is constructed in a manner which facilitates mating the connector with a female coaxial connector 21 which is threaded completely to front circular end face 121, and alternatively with a female coaxial connector 21A which has a front end face 121A that is joined by a radially outwardly tapered, peripheral annular chamfered surface 122A to threaded cylindrical surface 123A of the female connector. As shown in FIG. 9, modified male reduced threads coaxial connector 120 has a body 132, including front and rear tubular portions 133 and 134 which are fixed with respect to one another rather than being joined by rotatable union 85, as are front and rear sections 83, 84 of connector 80 shown in FIGS. 6-8 described above. However, as can be readily appreciated, connector 120 could of course include a rotatable union that would enable relative rotation between front and rear tubular portions 133, 134 of the connector.

As shown in FIG. 9, front tubular section 133 of connector 110 has an internal construction similar to that of front tubular portion 83 of connector 80 shown in FIGS. 6-8 and described above. Thus, the inner longitudinally disposed cylindrical wall surface 141 of front tubular section 133 of connector 120 has formed in a rear portion 142 thereof a helically threaded surface 143 which has a plurality, e.g., one to three of threads 144. As shown in FIG. 9, threaded surface 143 extends longitudinally forwards from an annular O-ring groove 145 located in the inner cylindrical wall surface 141 of front tubular section 133, near the front end of a rear tapered transition section 147 to a location offset a substantial distance rearwards of front annular wall surface 148 of the front tubular section. Preferably, a resilient sealing O-ring 145A is seated in O-ring groove 145. A front portion 149 of front tubular section 133, located between rear threaded portion 142 and front annular wall surface 148, has a smooth, unthreaded surface 150, thus forming a smooth entrance bore 151 to the front tubular section.

Referring still to FIG. 9, it may be seen that rear tapered transition section 147 of front tubular section 133 of connector 120 has a tapered counterbore 152 which extends axially rearwards from O-ring groove 145. Counterbore 152 is axially aligned with bore 151 through front tubular connector section 133, and provides a recessed clearance space for receipt of front chamfered edge 122A of female connector 21A.

Figure 10:
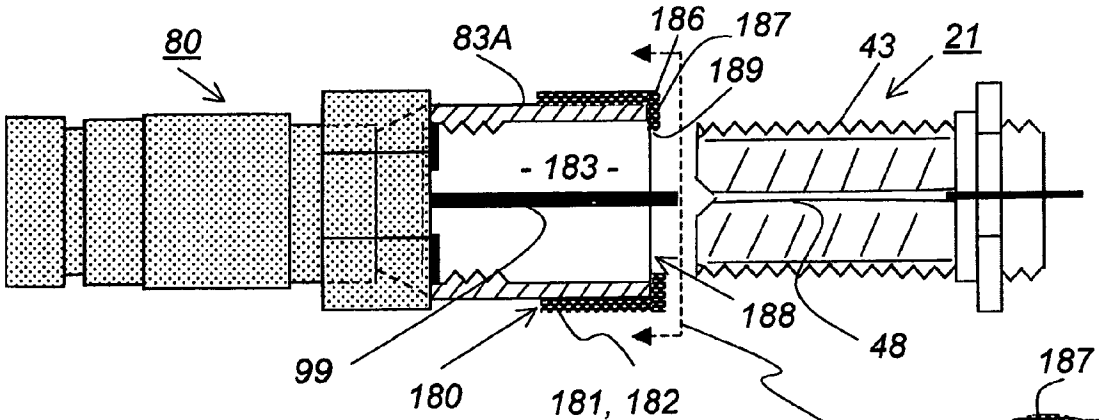
FIG. 10 is a partly sectional view of another modification of the connector of FIG. 6, which includes a "weather glove" according to the present invention, and a complementary female coaxial connector.
Figure 11:
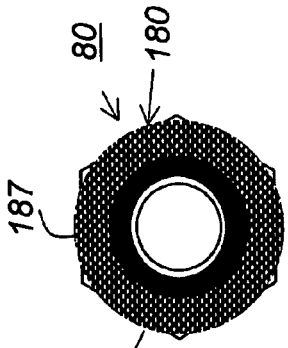
FIG. 11 is a front elevation view of the connector and weather glove of FIG. 10.
Figure 12:
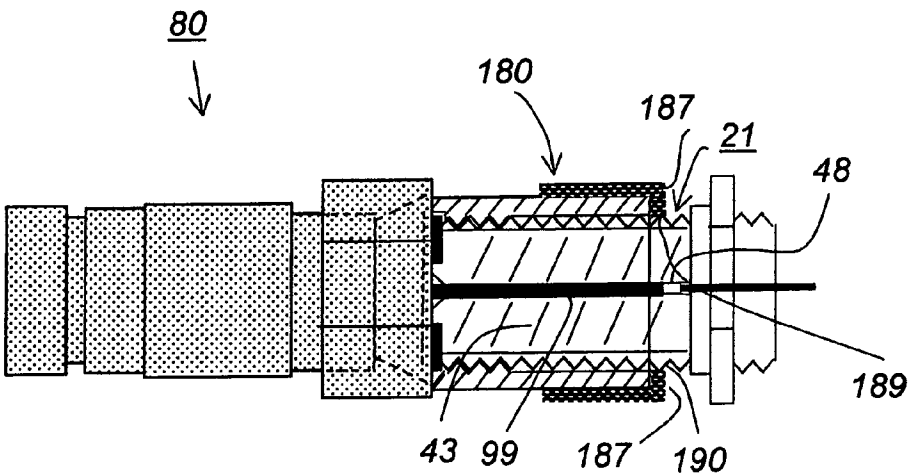
FIG. 12 is a view similar to that of FIG. 10, but showing the male and female connectors fully threadingly engaged.

FIGS. 10-12 illustrate a "weather glove" protective cover 180 according to the present invention for use with coaxial connectors. As shown in FIG. 10, weather glove 180, which is fabricated from a water impervious, elastomeric material such as silicone rubber, has a thin, uniform thickness body 181. Body 181 of weather glove 180 has the shape of a cylinder 182 which has disposed longitudinally therethrough a circular cross-section bore 183. Bore 183 is of a suitable diameter to fit tightly over the outer cylindrical wall surface 83A of front tubular section 83 of connector 80, i.e., a diameter of about 0.010 inch less than the diameter of the tubular connector section. Front annular transverse end wall 186 of weather glove body 181 has protruding radially inwardly therefrom a transversely disposed annular flange 187, Flange 187 has through its thickness dimension a coaxially located, circular perforation 188. Perforation 188 has a diameter slightly less, e.g., 0.010 inch, than the minimum diameter of the threaded front tubular portion 49 of a female connector 21. Thus, as shown in FIG. 12, when a male connector 80 is fastened to a female connector 21 with weather glove 180 attached, the inner circumferential wall 189 of perforation 188 through front flange section 187 of the weather glove resiliently penetrates thread roots 190 of the threaded female connector shell, thereby forming therewith a tight, water and dust-proof seal.

Figure 13:
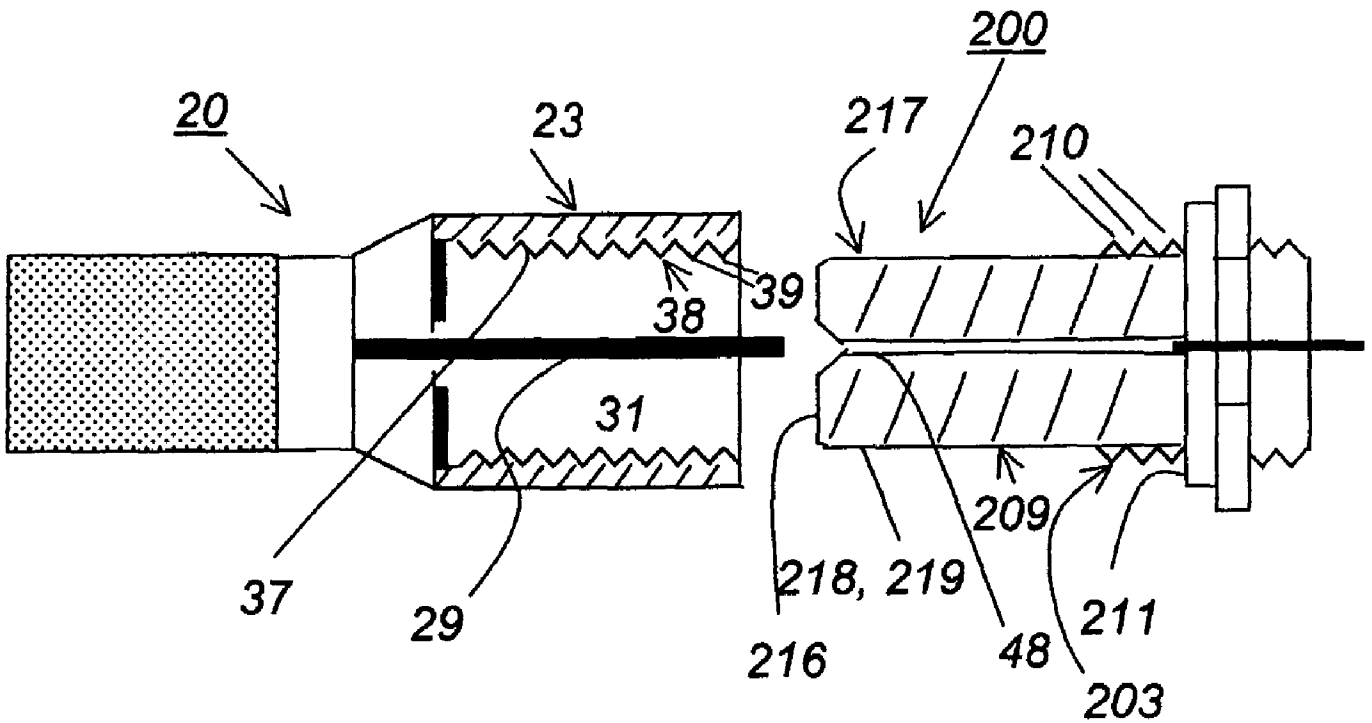
FIG. 13 is a partly fragmentary sectional view of a female reduced thread coaxial connector according to the present invention, and a complementary male connector.

FIG. 13 illustrates a female reduced threads coaxial connector 200 according to the present invention. As shown in FIG. 13, reduced threads female coaxial connector 200 is substantially similar in construction to prior art female coaxial connector 21 shown in FIG. 1 and described above. Thus, connector 200 has a longitudinally elongated, circular cross-section cylindrical shell 203 made of an electricity conductive material. Shell 203 has on an external cylindrical wall surface 209 thereof helically disposed threads 210 which extend forward from the base 211 of the connector to a location offset substantially inwards from front annular wall surface 216 of the connector shell. A front portion 217 of connector 200 located between rear threads 210 and front annular wall surface 216 has a smooth, unthreaded surface 218, thus forming a smooth front pilot cylinder 219.

Front pilot cylinder 219 of reduced threads female coaxial connector 200 has a diameter slightly smaller than the minimum inner diameter of helical threads 39 in the inner surface 37 of front tubular section 23 of a standard male coaxial connector 20, e.g., 0.010 inch. Therefore, smooth front cylindrical portion 219 of front portion 217 of reduced threads female coaxial connector 200 serves as a guide or pilot cylinder which constrains the axes of the male and female connectors to be substantially parallel when female connector 200 is inserted partially into male connector 20. Consequently, when the male and female connectors 20 and 200 are pushed together sufficiently far for the front threaded end of the female connector to contact a front outermost thread 39 of the male connector, the axes of the male and female connectors are constrained to be substantially aligned. This alignment ensures that when male connector 20 is rotated about its longitudinal axis in a predetermined clockwise or counterclockwise sense, depending on the chirality chosen for threaded surface 38, threads 39 of the male connector will threadingly engage threads 210 of the female connector, with no possibility of misalignment or cross-threading. Moreover, when male connector 20 is rotated in an opposite sense to disconnect the male connector from female connector 200, axial alignment of the connectors constrained by presence of a substantial forward length of front pilot cylinder 219 of female connector front tubular section 203 within the bore section of the male connector ensures that threads on neither connector will be damaged by prematurely misaligning the axes of the connectors as the last mating threads are loosened, as is possible with prior art, full-thread length connectors.

What is claimed is:

1. A coaxial male connector for electrically interconnecting center and outer conductors of first and second coaxial signal lines, said connector comprising:

a. a rear tubular connector body section which is adapted to attachment in electrically conductive contact to an outer conductive metal sheath comprising an outer conductor of a first coaxial signal line, said rear tubular body section having disposed longitudinally therethrough a rear coaxial bore for receiving a center conductor of said first coaxial signal line, b. a front tubular connector body section which is axially aligned with and in electrically conductive contact with said rear tubular body section, said front tubular connector body section having disposed longitudinally therethrough a front coaxial bore axially aligned with said rear coaxial bore and adapted to receive therethrough said center conductor of said first coaxial signal line, said front bore having in a front portion thereof a circumferential wall surface extending longitudinally rearwards from a front annular face of said front tubular connector section, said circumferential wall surface having a diameter larger than an outer diameter of an externally threaded female coaxial connector shell which said bore is adapted to receive, and said tubular front section having disposed longitudinally in a rear portion of said front bore an inner cylindrical wall surface thereof a helically threaded surface of smaller inner diameter than said front portion of said front bore and adapted to threadingly engage external threads of said female coaxial connector, and c. whereby said front portion of said front bore serves as a pilot tube for insertably receiving an externally threaded female connector and thus constraining said male and female connectors to be in substantial axial alignment before respective threaded surfaces of said male and female connectors make mutual contact.

2. The male connector of claim 1 wherein said front, larger inner diameter portion of said front bore of said front tubular body section has a length of at least 25 percent of the length of said rear threaded portion of said front tubular body section.

3. The male connector of claim 1 wherein said front, larger inner diameter portion of said front bore of said tubular body section has an unthreaded circumferential wall surface.

4. The male connector of claim 3 wherein said front, larger inner diameter portion of said front bore of said front tubular body section has a length of at least 25 percent of the length of said rear threaded portion of said front tubular body section.

5. The male connector of claim 1 wherein said front tubular connector body section has protruding radially inwardly from an inner wall surface thereof an annular ring- shaped flange which is located rearwardly of said helically threaded portion of said bore.

6. The male connector of claim 5 further including a resilient sealing washer seated on an outer, front surface of said flange wall.

7. The male connector of claim 1 wherein said front tubular connector body section has an unthreaded recess bore portion rearward of said helically threaded portion of said rear bore, said recess bore being adapted to receive a front transverse end wall of female connector threadingly engaged with said male connector.

8. The male connector of claim 7 further including an O-ring groove formed in an inner wall surface of said front tubular connector body section, said groove being located rearwards of said helically threaded section of said bore.

9. The male connector of claim 8 further including a resilient O-ring seated in said O-ring groove.

10. The male connector of claim 1 further including at least one pair of longitudinally disposed, circumferentially spaced apart flats formed in an outer wall surface of at least one of said front and rear tubular body sections, said flats being adapted to being gripped between jaws of a wrench to thereby facilitate rotation of said male connector to threadingly engage a female connector.

11. The male connector of claim 1 further including a rotatable union which joins said rear tubular body section to said front tubular body section, whereby said front tubular body section is rotatable to threadingly engage a female connector while said rear tubular body section remains fixed.

12. A male coaxial connector for electrically interconnecting center and outer conductors of first and second coaxial signal lines, said connector comprising:

a. a rear tubular connector body section which is adapted to attachment in electrically conductive contact to an outer conductive metal sheath comprising an outer conductor of a first coaxial signal line, said rear tubular body section having disposed longitudinally therethrough a rear coaxial bore for receiving a center conductor of said first coaxial signal line, b. a front tubular connector body section which is axially aligned with and in electrically conductive contact with said rear tubular body section, said front tubular connector body section having disposed longitudinally therethrough a front coaxial bore axially aligned with said rear coaxial bore and adapted to receive therethrough said center conductor of said first coaxial signal line, said front bore having in a front portion thereof a circumferential wall surface extending longitudinally rearwards from a front annular face of said front tubular connector section, said circumferential wall surface having a diameter larger than an outer diameter of an externally threaded female coaxial connector shell which said bore is adapted to receive, and said tubular front section having disposed longitudinally in a rear portion of said front bore an inner cylindrical wall surface thereof a helically threaded surface of smaller inner diameter than said front portion of said front bore and adapted to threadingly engage external threads of said female coaxial connector, c. a rotatable union which joins said rear tubular body section to said front tubular body section, and d. whereby said front portion of said front bore serves as a pilot tube for insertably receiving an externally threaded female connector and thus constraining said male and female connectors to be in substantial axial alignment before respective threaded surfaces of said male and female connectors make mutual contact.

13. The male connector of claim 12 wherein said front, larger inner diameter portion of said front bore of said front tubular body section has a length of at least 25 percent of the length of said rear threaded portion of said front tubular body section.

14. The male connector of claim 12 wherein said front, larger inner diameter portion of said front bore tubular body section has an unthreaded circumferential wall surface.

15. The male connector of claim 14 wherein said front, larger inner diameter portion of said front bore of said front tubular body section has a length of at least 25 percent of the length of said rear threaded portion of said front tubular body section.

16. The male connector of claim 12 wherein said front tubular connector body section has protruding radially inwardly from an inner wall surface thereof an annular ring-shaped flange which is located rearwardly of said helically threaded portion of said bore.

17. The male connector of claim 16 further including a resilient washer seated on an outer, front surface of said flange wall.

18. The male connector of claim 12 wherein said front tubular connector body section has an unthreaded recess bore portion rearward of said helically threaded portion of said rear bore, said recess bore being adapted to receive a front transverse end wall of female connector threadingly engaged with said male connector.

19. The male connector of claim 18 further including an O-ring groove formed in an inner wall surface of said front tubular connector body section, said groove being located rearwards of said helically threaded section of said bore.

20. The male connector of claim 19 further including a resilient O-ring seated in said O-ring groove.

21. The male connector of claim 12 further including at least one pair of longitudinally disposed, circumferentially spaced apart flats formed in an outer wall surface of said rotatable union.

22. The male connector of claim 12 wherein said rotatable union is further defined as a tubular polygonal cross-sectional-shaped body which coaxially overlies adjacent front and rear ends of said rear and front tubular connector body sections, respectively.

23. The male connector of claim 22 wherein said polygon cross-sectional shape is further defined as being a hexagon.

24. A coaxial connector for electrically interconnecting center and outer conductors of first and second coaxial signal lines, comprising:

a. a male connector comprising:

i. a rear tubular connector body section which is adapted to attachment in electrically conductive contact to an outer conductive metal sheath comprising an outer conductor of a first coaxial signal line, the rear tubular body section having disposed longitudinally therethrough a rear coaxial bore for receiving a center conductor of the first coaxial signal line, and ii. a front tubular connector body section which is axially aligned with and in electrically conductive contact with the rear tubular body section, the front tubular connector body section having disposed longitudinally therethrough a front coaxial bore axially aligned with the rear coaxial bore and adapted to receive therethrough the center conductor of the first coaxial signal line, the front bore having in a front portion thereof a circumferential wall surface extending longitudinally rearwards from a front annular face of the front tubular connector section, said circumferential wall surface having an inner diameter, and the tubular front section having disposed longitudinally in a rear portion of the front bore an inner cylindrical wall surface thereof a helically threaded surface of smaller inner diameter than the inner diameter of the front portion of the front bore; and b. a female connector comprising:

i. a rear tubular connector body section which is adapted to attachment in electrically conductive contact to an outer conductive metal sheath comprising an outer conductor of a first coaxial signal line, ii. an insulated cylinder which protrudes forward from the rear tubular connector body, the cylinder having extending coaxially rearward from a front transverse face thereof a conductive metal ferrule having a front entrance opening adapted to receive a center conductor of the male connector, the ferrule being electrically conductively connectable at an inner, rear end thereof to a center conductor of the first coaxial signal line, iii. an elongated cylindrically-shaped outer conductive shell disposed longitudinally and coaxially over the insulated cylinder, the conductive shell being in electrically conductive contact with the rear tubular connector body section and having a front cylindrical portion which has a smaller outer diameter than the inner threaded wall surface of the male connector, and a rear cylindrical portion which has a helically threaded surface adapted to engage the internally threaded wall surface of the male connector, and c. whereby the front portion of the front bore serves as a pilot tube for insertably receiving the female connector and thus constraining the male and female connectors to be in substantial axial alignment before respective threaded surfaces of the male and female connectors make mutual contact.

25. The coaxial connector of claim 24 wherein the front, larger inner diameter portion of the front bore of the front tubular body section has a length of at least 25 percent of the length of the rear threaded portion of the front tubular body section.

26. The coaxial connector of claim 24 wherein the front, larger inner diameter portion of the front bore of the tubular body section has an unthreaded circumferential wall surface.

27. The coaxial connector of claim 24 further including an O-ring groove formed in an inner wall surface of the front tubular connector body section, the groove being located rearwards of the helically threaded section of the bore.

* * * * *